US006050787A

United States Patent [19]

Hesketh

[11] Patent Number: 6,050,787

[45] Date of Patent: Apr. 18, 2000

[54] MAGNETICALLY ACTUATED FLEXIBLE TUBE PUMP

[76] Inventor: Mark R Hesketh, 1 Church Lane, Wroxton, Oxfordshire, OX15 6QE, United Kingdom

[21] Appl. No.: 08/870,156

[22] Filed: Jun. 12, 1997

[30] Foreign Application Priority Data

Jun. 26, 1996 [GB] United Kingdom ..... 9613429

[51] Int. Cl.[7] ..... F04B 43/00

[52] U.S. Cl. ..... 417/412; 417/53; 417/478; 92/170.1; 251/61.1; 251/129.01

[58] Field of Search ..... 417/412, 478, 417/479, 53; 92/170.1; 251/61.1, 129.01

[56] References Cited

U.S. PATENT DOCUMENTS

| | | | |
|---|---|---|---|
| 1,498,010 | 6/1924 | Bellman | 92/170.1 |
| 3,792,720 | 2/1974 | Robbins | 251/61.1 |
| 4,449,893 | 5/1984 | Beckman et al. | 417/412 |
| 4,452,572 | 6/1984 | Evrard | 417/478 |
| 5,147,185 | 9/1992 | Niehaus et al. | 417/478 |
| 5,671,905 | 9/1997 | Hpkins et al. | 251/129.01 |

FOREIGN PATENT DOCUMENTS

| | | | |
|---|---|---|---|
| 2235256 | 2/1991 | United Kingdom | 417/412 |

*Primary Examiner*—Charles G. Freay

[57] ABSTRACT

A flexible tube pump, reference FIG. 2, having an elastic tube 1, compounded with a magnetically responsive material, stretched onto the surface of shaft 2 to provide a seal between the contacting surfaces. A magnetic field is applied concentrically to tube 1 which expands circumferentially away from shaft 2, but only locally to the field, the region outside the influence of the magnetic field however maintains the tube 1 to shaft 2 seal. The expansion of tube 1 forms volume 7. Repetitive movement of said magnetic field in direction of arrow 6 provides moving closed volumes giving pumping action, suitable as a dry, low pressure, pump, e.g. a vacuum pump.

7 Claims, 2 Drawing Sheets

MAGNETICALLY ACTUATED FLEXIBLE TUBE PUMP

This invention relates to a flexible tube pump. Such pumps are used for the transportation and pressurization of shear sensitive media, more particularly this invention relates to applications for dry vacuum generation. For many applications in the vacuum field it is the achievement of a "Clean" vacuum that is the essential need. This is why pumps which use oil primarily to create vacuum tight seals are more frequently being replaced by dry pumps such as Scroll pumps and diaphragm pumps. Unfortunately these designs are either very costly to manufacture or as in the case of single stage diaphragm pumps restricted by their vacuum limit.

Common forms of pumps with a flexible member are the bellows and diaphragm pumps. Here the diaphragm is normally made from an elastomer forming part of the volume being pumped. By reciprocating the flexible member within the pump head space, in which are usually located inlet and outlet one-way valves, the media being pumped enters then is forced out of the pump head. The mechanism for actuating the flexible member is normally by linkage to a motor or by valved compressed air. This mechanism performs satisfactorily for pressure transmission of fluids, however such pumps are not well suited for use at vacuums below 100 millibar, providing only dry rough vacuum because of the trapped dead volume present in the head space.

The prior invention "Dry Vacuum Diaphragm Pump", U.S. Pat. No. 4,452,572, Jun. 5, 1984, by inventor Robert Evrard is art known to the applicant. This invention is applicable to generating dry vacuum when acting as an additional stage to a conventional vacuum pump. It cites a tubular diaphragm which by admitting a pressure differential across the diaphragm allows said diaphragm to conform to the contour of the pumping chamber body and thus expel gas via a top valve. However, it's vacuum performance is limited by the trapped volume in the head space subsequently recombining with the inlet gas on each cycle of the pump. This limitation, at least, is resolved by the invention claimed here-in.

In summary the present invention provides a pump comprising a magnetically responsive elastic tube stretched onto, thereby sealing to, a shaft with inlet and outlet ports at or adjacent to it's ends of the tube. Local to the inlet port a magnetic field is generated in the enclosing body. This field is substantially concentric to the tube, which then responds by expanding circumferentially towards the magnetic field. This creates a volume between the tube and shaft, the length of tube outside the influence of the magnetic field remains sealed upon the shaft. Subsequent movement of the magnetic field along the axis of the pump gives transport of this volume and any media now enclosed within it from the inlet port to the outlet port, whereupon reduction of the magnetic field results in exhaustion of the volume. This cycle results in pumping action.

Figure 1:
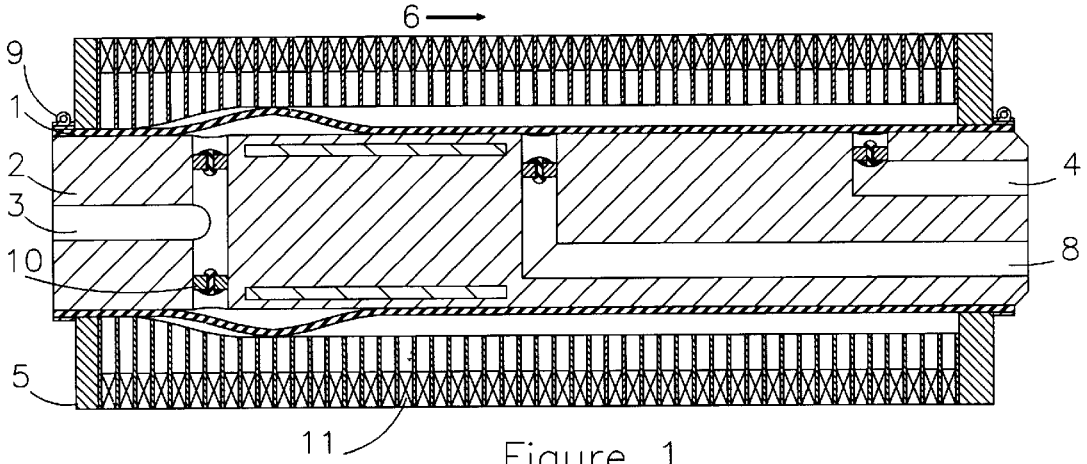
FIG. 1 illustrates the pump in cross section with the tube attracted to the applied magnetic field adjacent to the pump inlet.

Referring to the drawing FIG. 1., the pump comprises a tube 1, the internal diameter of the as formed tube 1 being less than the shaft 2 to which the tube 1 has been stretched to tightly fit, thereby proving an axial seal between tube 1 and shaft 2. The tube 1 ends are fixedly sealed to the shaft 2 by band clamps 9, other equivalent mechanical means or adhesives. The shaft 2 has ports at or adjacent to either end, forming the inlet 3 and outlet 4. The inlet 3 and outlet 4 may be individually valved within their ports by using one way valves 10 or alternatively the tube 1 material compliance at the shaft 2 interface of the inlet 3 and outlet 4 openings enables direct use of the tube 1 for valving purposes. This latter option would be a preferable format since it both further reduces the volume of retained pumping media and parts count. Such a one way valve 10 may be located along the shaft 2 part way between the inlet 3 and outlet 4 within an intermediate port 8 for gas ballasting purposes. The body 5 which surrounds the tube 1 contains electrical hardware, this may use the stator technology from a tubular linear motor with a switched sequence of coils 11 for the generation of one or more magnetic fields, concentric to the tube 1. It is obvious that sufficient field need be generated to make most effective use of the tube, however because the design of the field generator is not novel and within the scope of those practiced in the art, it is therefore unnecessary here to record the detail design of the electrical hardware. To match the process demand of the pumping application the operator and or pump management system may be given provision through the electrical hardware to vary field strength and distribution and motion along the tube 1 axis, in the direction of arrow 6. In order for the tube 1 to react physically to the magnetic field generated by the body 5 then the tube 1, for the purposes of this invention, is to be both elastic and have magnetically responsive properties. To provide this the tube 1 may be made from an elastomer, such as Butyl, which has been compounded with a magnetically soft material, such as an Iron Oxide powder. This can be readily produced by a surface hardened rotary mill which are commonly used for calendering sheet rubber. Alternatively the base tube 1 material may be linked mechanically or by adhesive bonding to a periphery of magnetically responsive material or the tube 1 may envelope a discrete quantity of magnetically responsive material.

Figure 2:
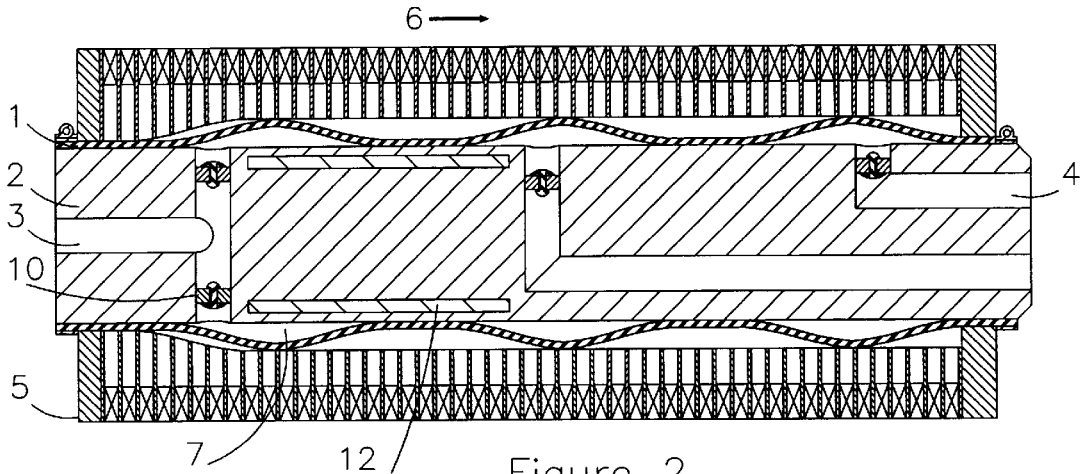
FIG. 2 illustrates the effect of movement of multiple magnetic fields on the tube and how this may be used to give pumping action.

FIG. 2 illustrates the effect of multiple, sequential magnetic fields generated by the body 5 upon the tube 1, this tube 1 expands circumferentially in a zone local to each magnetic field, as a consequence of a balance of forces which include the pull of the magnetic field and the restitutional force of the elastomer. At or adjacent to inlet 3 the expansion of the tube 1 enables the media which is to be pumped to freely enter the volume 7, either because of the resultant pressure differential now opening the inlet one way valve 10 or more simply because of the action of the compliant tube 1 material lifting from the inlet 3 to tube 1 interface were this valving format used. The volume 7 so formed progresses in the direction of arrow 6 by magnetic attachment to the magnetic field which is moving in linear fashion in that direction, the movement of what has now effectively become the closed volume 7 gives a pumping action. It is this closed volume 7 which enables the pumping action to generate vacuum at inlet 3. The media being transported in volume 7 is totally or partly exhausted from the outlet 4 by allowing the magnetic field to diminish at or adjacent to outlet 4 and causing the tube 1 to contract. When the pump uses a multiplicity of sequential magnetic fields, each discretely causing a localised circumferential expansion of the tube 1, it thereby creates a labyrinth of pumping volumes to minimise the losses because of back leakage. The shaft 2 may itself be a source of one, or more, magnetic fields as an aid to the restorative force of the tube 1, this may be provided by fixed permanent magnets 12 and or electrical hardware within the shaft 2.

Figure 3:
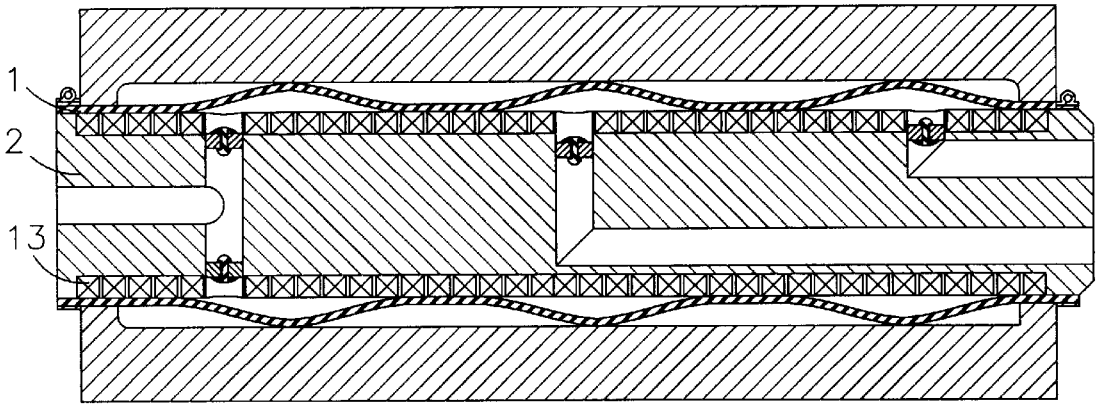
FIG. 3 illustrates the pump in cross section, the shaft containing the equipment for the generation of magnetic fields from which the tube is repulsed.

FIG. 3 illustrates the tube 1 in magnetic repulsion from the area of applied magnetic field. For this embodiment of the present invention shaft 2 has electrical hardware 13 for the generation of magnetic fields and the tube 1 shall have been compounded with a magnetically responsive material such that prior exposure of the tube 1 to a magnetising field has given a domain orientation of the magnetically responsive material enabling the tube to respond to an applied magnetic field as for a flexible permanent magnet.

Where the invention uses just one magnetic field and the inlet 3 and outlet 4 ports are sufficiently adjacent so that the magnetic field causes the tube 1 to create one volume enabling both ports to communicate, then it may be utilised as a basic valve.

What I claim as my invention is:

1. A pump comprising:

a magnetically responsive elastic tube stretched onto and thereby sealing to and encasing a shaft, said shaft having first and second ends with inlet and outlet ports adjacent to said ends;

an enclosing body containing electrical hardware which forms a magnetic field generation means for generating and axially moving a magnetic field along said shaft, the magnetic field initially surrounding the inlet port of said shaft, the said tube responding by expanding circumferentially in magnetic attraction towards the magnetic field so creating a volume between said tube and said shaft;

the lengths of tube outside the influence of the magnetic field remaining sealed to said shaft such that subsequent movement of the magnetic field along the axis of said shaft transports the material enclosed within said volume along said shaft from the inlet port to the outlet port;

reduction of the magnetic field following transport of the material from said inlet to said outlet port resulting in exhaustion of the volume, repetition of this cycle creating a pumping action.

2. A pump as claimed in claim 1 wherein more than one magnetic field is in sequence applied concurrently to the tube length.

3. A pump as claimed in claim 1, wherein one or more supplementary magnetic fields are supplied internal to the tube, for the augmentation of tube to shaft seal.

4. A pump comprising:

a magnetically responsive elastic tube stretched onto and thereby sealing to and encasing a shaft, said shaft having first and second ends with inlet and outlet ports adjacent to said ends and said tube having a retained remnant magnetic field;

within the said shaft there being electrical hardware which forms a magnetic field generation means for generating and axially moving a magnetic field along said shaft, the magnetic field is initially generated from within the inlet port of said shaft, the said tube responding by expanding circumferentially in magnetic repulsion from the magnetic field so creating a volume between said tube and said shaft;

the lengths of tube outside the influence of the magnetic field remaining sealed to said shaft such that subsequent movement of the magnetic field along the axis of said shaft transports the material enclosed within said volume along said shaft from the inlet port to the outlet port;

reduction of the magnetic field following transport of the material from said inlet to said outlet port resulting in exhaustion of the volume, repetition of this cycle creating a pumping action.

5. A method of using the pump of either of claims 1 or 4 as a valve comprising:

applying a magnetic field to the magnetically responsive tube with the magnetic field generation means across at least the length of said tube between said inlet and said outlet ports so that a volume created by expansion of said tube interconnects said inlet and outlet ports and creates a flow path, and closing the flow path by controlling the magnetic field generation means to remove the magnetic field applied to said tube, thus causing the tube to contract against said tube and close said flow path.

6. A valve comprising:

a magnetically responsive elastic tube stretched onto and thereby sealing to and encasing a shaft, said shaft having first and second ends with inlet and outlet ports adjacent to said ends;

an enclosing body containing electrical hardware which forms a magnetic field generation means for generating and applying a magnetic field across at least the length of said tube between said inlet and outlet ports, said tube expanding circumferentially in magnetic attraction towards the magnetic field and forming a flow path from said inlet port to said outlet port, the flow path being formed between said shaft and said tube;

a reduction of the magnetic field applied by the magnetic field generation means resulting in said tube contracting circumferentially to a sealing position against said shaft.

7. A valve comprising:

a magnetically responsive elastic tube stretched onto and thereby sealing to and encasing a shaft, said shaft having first and second ends with inlet and outlet ports adjacent to said ends and said tube having a retained remnant magnetic field;

within said shaft there being electrical hardware which forms a magnetic field generation means for generating and applying a magnetic field across at least the length of said tube between said inlet and outlet ports, said tube expanding circumferentially in magnetic repulsion away from the magnetic field and forming a flow path from said inlet port to said outlet port, the flow path being formed between said shaft and said tube;

a reduction of the magnetic field applied by the magnetic field generation means resulting in said tube contracting circumferentially to a sealing position against said shaft.

* * * * *